United States Patent [19]

Dennis

[11] Patent Number: 4,548,108

[45] Date of Patent: Oct. 22, 1985

[54] SLICING MACHINE

[75] Inventor: Edmund G. Dennis, Belle Terre, N.Y.

[73] Assignee: Cashin Systems Corporation, Hauppauge, N.Y.

[21] Appl. No.: 521,312

[22] Filed: Aug. 8, 1983

[51] Int. Cl.[4] ..... B26D 5/32

[52] U.S. Cl. ..... 83/27; 83/13; 83/42; 83/77; 83/80; 83/371

[58] Field of Search ..... 83/77, 42, 27, 29, 80, 83/13, 371, 89

[56] References Cited

U.S. PATENT DOCUMENTS

| | | | |
|---|---|---|---|
| 3,379,233 | 4/1968 | Kasper | 83/77 X |
| 3,846,957 | 11/1974 | Divan | 83/77 X |
| 3,846,958 | 11/1974 | Divan | 83/77 X |
| 3,880,035 | 4/1975 | Divan | 83/420 |
| 4,065,911 | 1/1978 | Fagan | 83/77 X |
| 4,226,147 | 10/1980 | Kumzi | 83/77 X |

*Primary Examiner*—Donald R. Schran

*Attorney, Agent, or Firm*—Kane, Dalsimer, Kane Sullivan & Kurucz

[57] ABSTRACT

The present device relates to a slicing machine for slicing bacon bellies continuously. The device is provided with a trim circuit which detects the front and rear ends of each belly and generates a trimming signal which triggers the trimming of said ends. Slice counters are provided which the number of slices to be cut from a belly before trimming can be preselected for either the front or the rear ends.

The device is also provided with a control circuit which reverses the forward movement of a belly after slicing process is temporarily stopped so that both the last slice before the stoppage and the first slice sliced after the stoppage have a relatively even cross-section.

11 Claims, 14 Drawing Figures

Fig.1
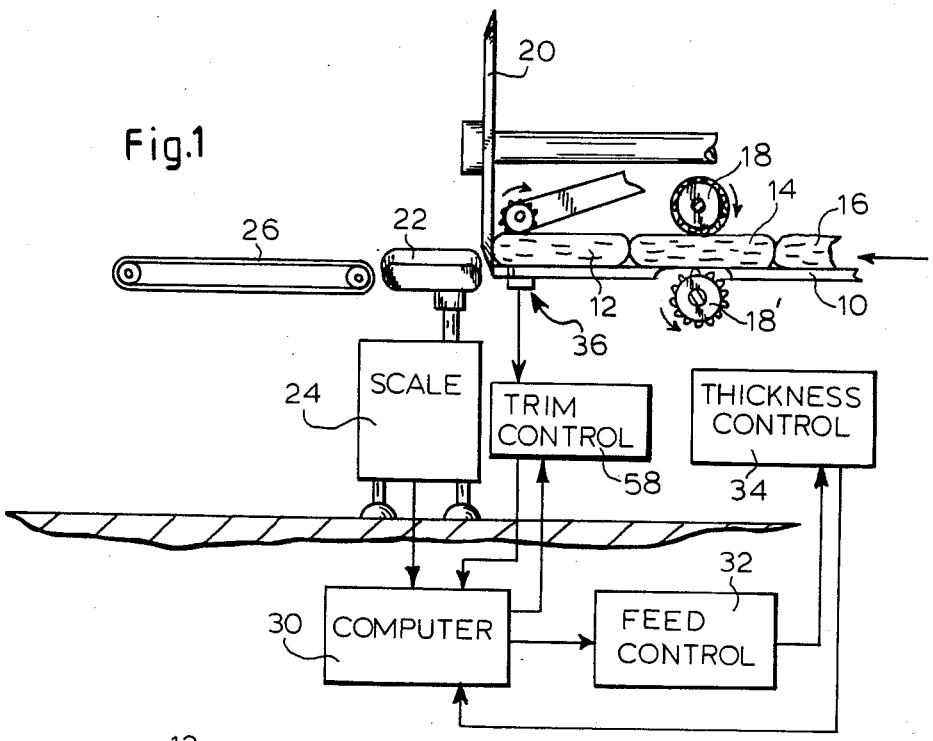
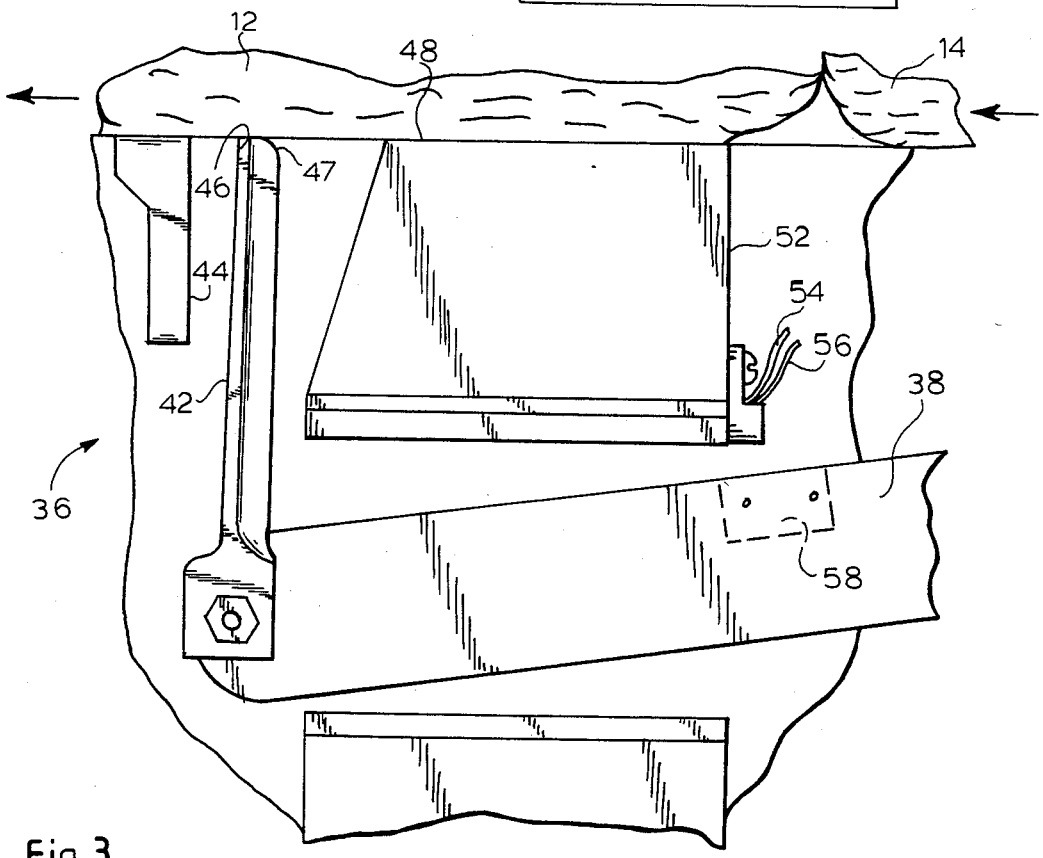
Fig.3

SWITCH STATUS CIRCUIT
PULSE GENERATING
REAR TRIM CIRCUIT
FRONT TRIM CIRCUIT
TRIM PULSE
CLEAR
BINARY DECODER
RESET BINARY COUNTER
NAND
F/F
TP
SWITCH SIGNAL
SLICE PULSES
52
52
86
90
84
88
80
82
118
120
122
124
126
194
112
114
116
110
108
106
104
102
100
98
96
68

SLICING MACHINE

BACKGROUND OF THE INVENTION

1. Field of Invention

This invention relates to machines for slicing products packaged in irregular shapes, and more particularly for slicing in a continuous fashion meat products and the like.

2. Description of the Prior Art

There exists today a variety of types of slicing machines utilized in meat slicing operations which are adapted to accept and slice meat packaged in irregular shapes such as bacon in a continuous fashion. Typically the sliced material is collected by a weighing conveyor belt which weighs the slices and then transfers the material for further processing.

Existing slicing machines do not have totally acceptable provisions for handling irregularly shaped slices which results from either the front or the rear end of a meat package. Typically these packages such as for example bacon bellies have irregular cross-sections at the front and rear ends, and since marketers as well as consumers favor slices having uniform or approximately the same cross-sectional area, the slices from the ends must be separated and segregated from the main body slices prior to further processing. In prior art machines this was routinely accomplished by attempting to trim the front and rear end of each belly either manually or otherwise. This technique is unsatisfactory and oftentimes reduces the efficiency of the machines.

Another disadvantage of the existing machines is that due to the inherent design of the machines and the physical characteristics of the material, when the feed of a slicer was stopped, while a meat product such as a bacon belly, is being sliced, the piece has a tendency to slump or lean forward into the cutting zone so that each time the slicer is stopped, a sliver is produced. Furthermore due to the fact that the slicing operation was momentarily stopped by halting the forward movement of the belly, if this stoppage occurred in the middle of the belly the last slice before the stoppage and the first slice after the stoppage had an uneven, undesirable thickness.

OBJECTIVES AND SUMMARY OF THE INVENTION

Therefore an objective of the present invention is to provide an improved slicer in which the ends of a meat product such as a bacon belly are automatically separated from the normal slices.

Another objective is to provide an improved slicer in which slices of even and uniform thickness are produced when the slicer is stopped and is restarted in the middle of a belly.

These and other advantages are described in the description of the invention given below.

In accordance to the present invention, an improved slicer for a meat product such as a bacon belly comprises a platform, slicing blade means positioned adjacent to said platform, motive feed means for advancing bellies disposed on said platform toward said slicing means, means for removing slices cut off by said slicing means, control means for controlling said belly advancing means and slice removal means, and sensing means for sensing the front and rear end of each belly operatively connected to said control means whereby slices cut off from the front and rear end of a belly may be trimmed and processed separately from slices obtained therebetween.

Using the above device, the slicing operation of a belly comprises advancing the bellies toward a slicing blade, sensing the front end of each belly, trimming the front end, slicing the main body of the belly, sensing the rear end of the belly and trimming said rear end.

In order to eliminate the above-mentioned problem of uneven slices caused by stopping the forward movement of the belly in the middle of slicing when segregating one group of slices from the next, the feed means are adapted to move the belly being sliced toward and away from said slicing means. The operation is controlled by a process control means which generates a "start" and "stop" signal for halting and re-starting the slicing operation. Feed control means are provided which cause said feed means to move the bellies toward the slicing means when the "start" signal is received, and which cause the feed means to move the belly being sliced back, away from the slicing means when a "stop" signal is received.

BRIEF DESCRIPTION OF THE DRAWINGS

FIG. 1 is a partly-schematic side view of the subject slicing machine;

FIG. 3 is a side view of the switch assembly

DESCRIPTION OF THE PREFERRED EMBODIMENT

Figures 2, 4:
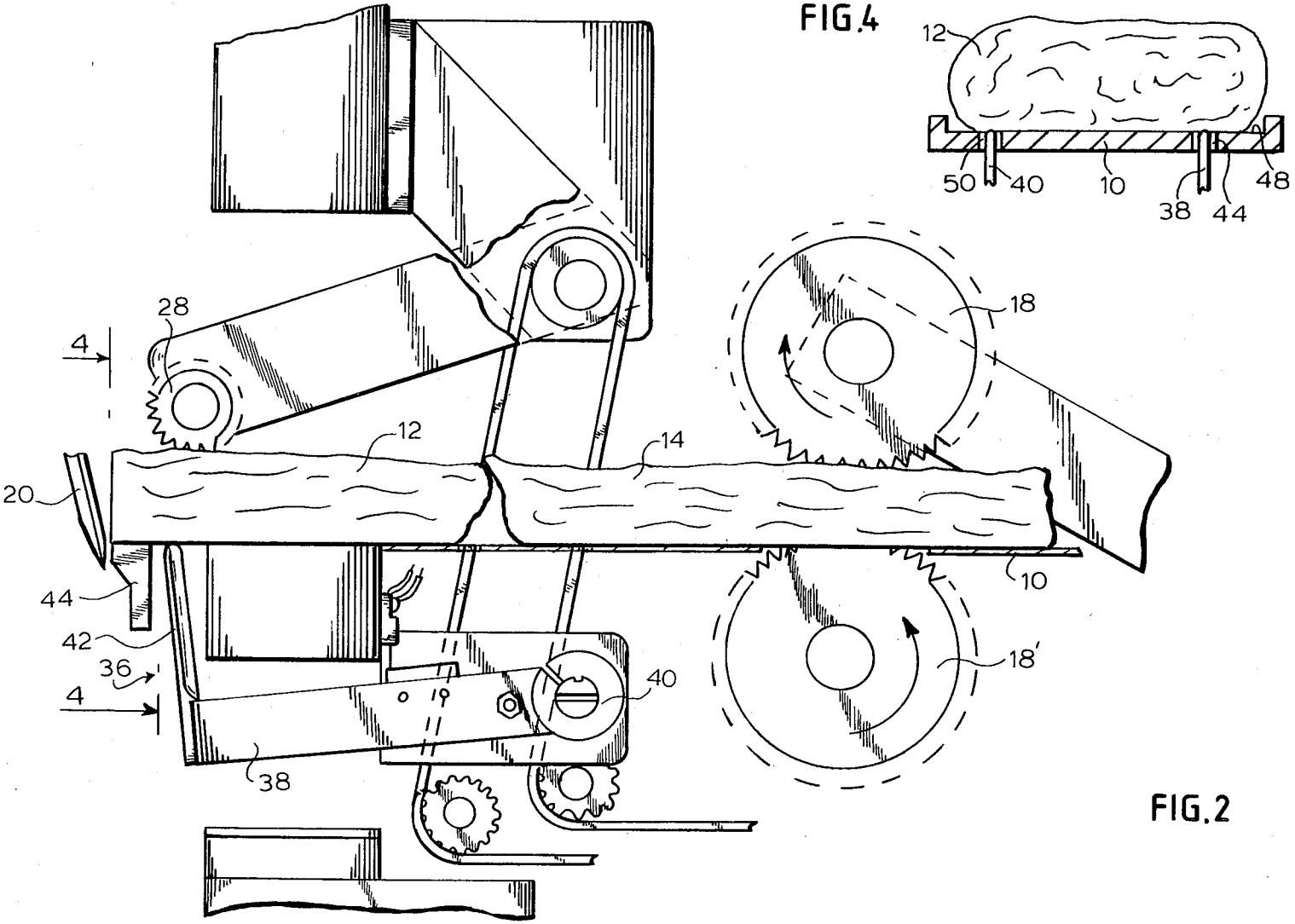
FIG. 2 is a side view of the platform leading to the slicing knife.

As illustrated in FIG. 1, an improved slicing machine according to this invention comprises a platform 10 on which a plurality of bacon bellies 12, 14 and 16 are pushed along to the left, as indicated by the arrow, by opposing wheels or drums 18 and 18'. At the end of the platform a rotary slicing knife 20 is provided to slice the bellies. The bacon slices are collected by a conveyor belt 22 which is supported by a scale 24. After the slices are weighed they are delivered by belt 22 to another conveyor belt 26 for further processing.

Just before the knife 20, the bellies are driven by a wheel 28 which, in addition, holds the bellies down during slicing. Wheel 28 is driven by a belt or other similar means and its position is vertically adjustable to compensate for the dimensional variations of the bellies.

The weight of the slices is transmitted by the scale to a computer 30 which controls the rate of feed of the bellies accordingly through a feed control circuit 32. The output of the feed control circuit is also connected to a thickness control circuit 34 for varying the thickness in a predetermined manner to obtain a group of bacon slices having a preselected number of slices and preselected weight. This type of arrangement is more fully described in a number of commonly assigned patents including U.S. Pat. No. 3,846,958 granted on Nov. 12, 1974 and U.S. Pat. No. 3,880,035 granted on Apr. 29, 1975, to William J. Divan, and U.S. Pat. No. 4,065,911 granted on Jan. 3, 1978 to John L. Fagan, and incorporated herein by reference.

A switch assembly 36 is provided in this invention to indicate the front and rear ends of each bacon belly. As seen in FIG. 2, 3, and 4, the assembly preferably comprises two independent L-shaped arms 38 and 40 disposed transversally the machine direction i.e. transversally to the direction of movement of said bellies. Arm 38 is pivotally mounted at point 40 underneath the platform and it has a vertical member 42 adapted to extend through a hole 44. Arm 38 is biased by a spring (not shown) so that it tends to extend its vertical member through hole 44, with its tip 46 being disposed at a preselected distance above the top surface 48 of platform 10. However, as is the case in FIGS. 2 and 3, when a belly is located right on top of hole 44, the arm is pushed down so that the tip 46 is substantially even with top surface 48.

Thus as the bellies move past the switch assembly, the L-shaped arms, 38, 40 which are being urged upward through respective holes 44, 50 by springs, go through a reciprocating vertical motion, each upward movement indicating a rear belly end and each downward movement indicating a front belly end.

At least one edge 47 of top 46 is rounded so that the arm can move up and down as the bellies move by without any interference therebetween and without damaging the bellies.

Each L-shaped arm is associated with an electric switch such as 52 which is adapted to close and open an electric circuit through wires 54 and 56. The electric switch could comprise for example a reed-type proximity switch which is opened and closed by a magnet 58 disposed on arm 38. There are many other ways well-known to one skilled in the art to activate switch 52 by the position or arm 38.

Figure 5:
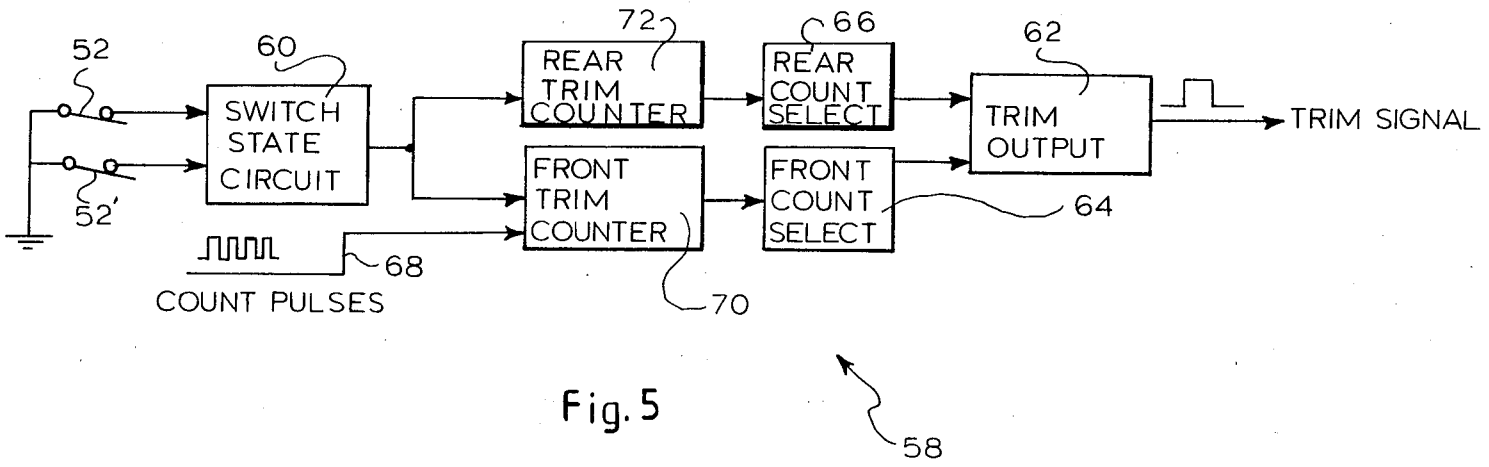
FIG. 5 is a block diagram of the trim control circuit.

The switch assembly is connected to the trim control circuit 58 which generates a trim control signal sent to computer 30. The elements of the trim control circuit are shown in FIG. 5 and their operation shall now be described in conjunction with the operation of the slicing machine.

Figure 6:
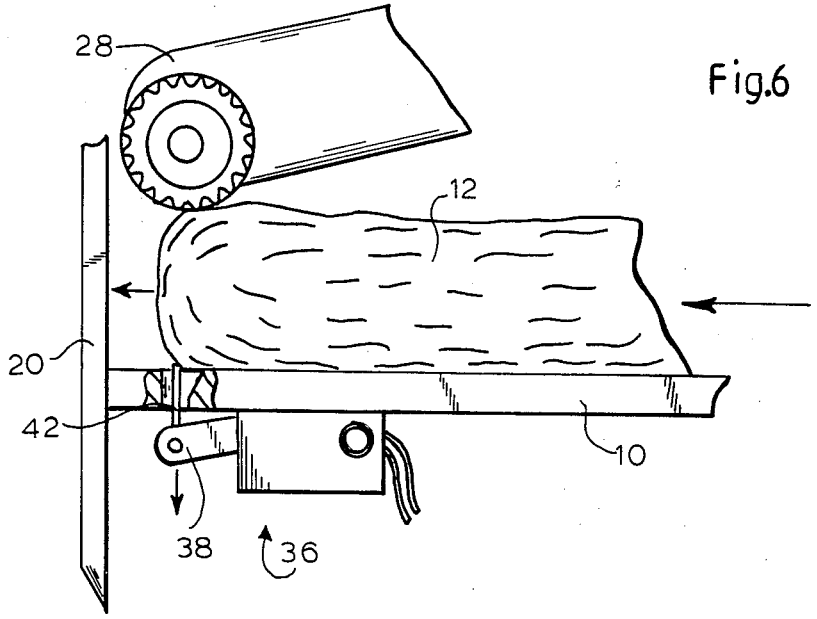
FIGS. 6–9 show progressive details of the front and rear end trimming.

Initially there is nothing positioned on top of L-shaped members 38, 40, so that their tips are disposed above the platform 10. In this position switches 52 and 52' (FIG. 5) activated by arms 38 and 40 respectively are closed. The operation of the machine is started by activating the slicing blade 20 and wheels 18, 18' and 28 which start pushing the first belly 12 toward slicer 20 along platform 10. When the belly reaches the switch assembly (as shown in FIG. 6) both switches 52, 52' open and the switch state circuit 60 generates a switch signal which is "high" when the switches are opened and "low" when the switches are closed. The "high" switch signal indicates that a belly has been detected while a "low" switch signal indicates a space between the bellies. In other words a "low" to "high" transition indicates the front end of a belly while a "high" to "low" transition indicates a rear end.

In response to this transition a trim output circuit 62 generates a trim signal pulse to the computer. However, if desired, a delay is inserted by the trim circuit between a switch signal transition and the trim signal. The purpose of this delay is to allow the respective end of the belly to travel from the switch assembly to the slicing blade, and to compensate for cross-sectional irregularities of the belly, as shall be described in more detail below.

The number of slices to be sliced off the front end and the rear end prior to trimming is preselected by the operator through front count select means and rear count select means 64 and 66. A series of pulses are fed on line 8 to front trim counter 70 and rear trim counter 72. The front trim counter 70 is enabled by the front end transition of the switch signal so that it starts counting the number of pulses on line 68. Although these pulses can represent an arbitrary clock, preferably they should be synchronized with the slicing blade 20 so that each pulse represent a slice cut by the blade. Therefore the front trim counter is counting the number of slices cut after the front end transition of the switch signal.

Figure 7:
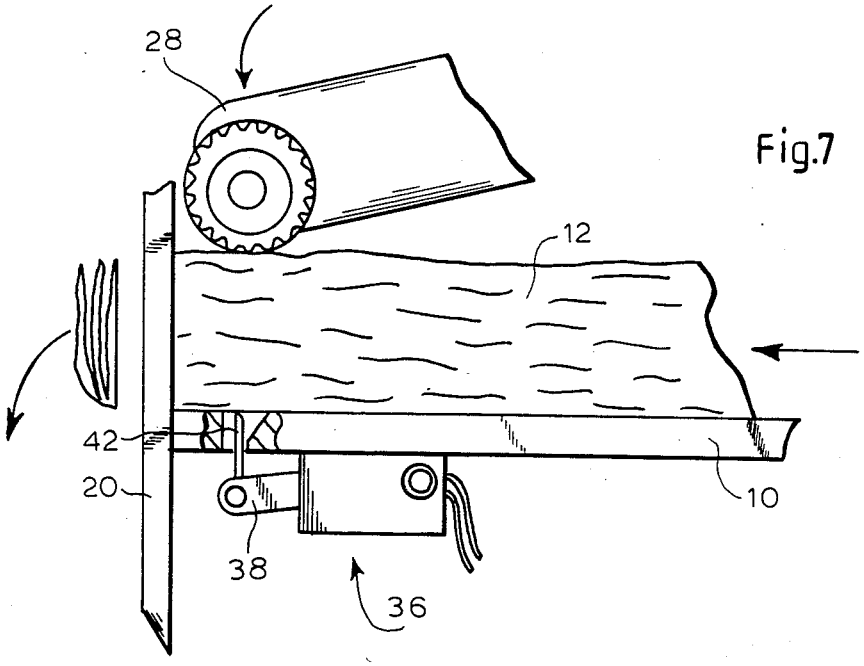

When the front end counter 70 reads the count preselected by the operator on the front count select means 64, the trim output circuit 62 is activated to generate the trim pulse. Between the time that the first belly 12 is detected and the trim pulse is generated the belly moves toward the slicer. A predetermined number of slices are cut off from the front end (as shown on FIG. 7) and disposed on the scale conveyor 22.

When the computer 30 receive the trim control signal the following sequence of operations is performed:

1. The forward movement of belly 12 is stopped.
2. The scale conveyor 22 and conveyor 26 are switched to a high speed to remove the trimmed slices cut off from the front end for separate processing;
3. The thickness control circuit 34 is reset for normal slicing.
4. The forward feed of the bacon is re-started.

From this point on the machine follows its normal operation outline above. During this phase both switches stay opened because the respective L-shaped arms are being pushed down by the belly 12.

The rear end of the belly is detected by one or both of the switches (see FIG. 9) which causes a "low" to "high" transition in the switch signal of the trim control circuit 58. The switch assembly is "upstream" of the slicer and therefore belly 12 still has some good slices left. Therefore normal slicing operation continues after the "low" to "high" transition of the switch signal for a number of slices pre-selected by the operator through rear count select means 66. Just like in the "front end" phase of the operation, both the slice pulses from line 68 and the switch signal are fed to a rear trim counter. When the rear counter output equals the number of the rear count select means 66 the trim output circuit 62 generates a second trim signal. During this "rear end" phase of the operation, when the computer 30 receives the second trim signal, the following sequence of operation is performed:

1. The forward movement of the bellies is stopped.
2. The scale conveyor 22 and conveyor 26 are switched to high speed to remove the last regular slices of belly 12, and get ready for the processing of the trimmed slices from the front end of the next belly 14.
3. The forward movement of the bellies is restarted.

This completes a processing cycle of a belly. The cycle is repeated for each subsequent belly 14, 16 etc.

Figure 9:
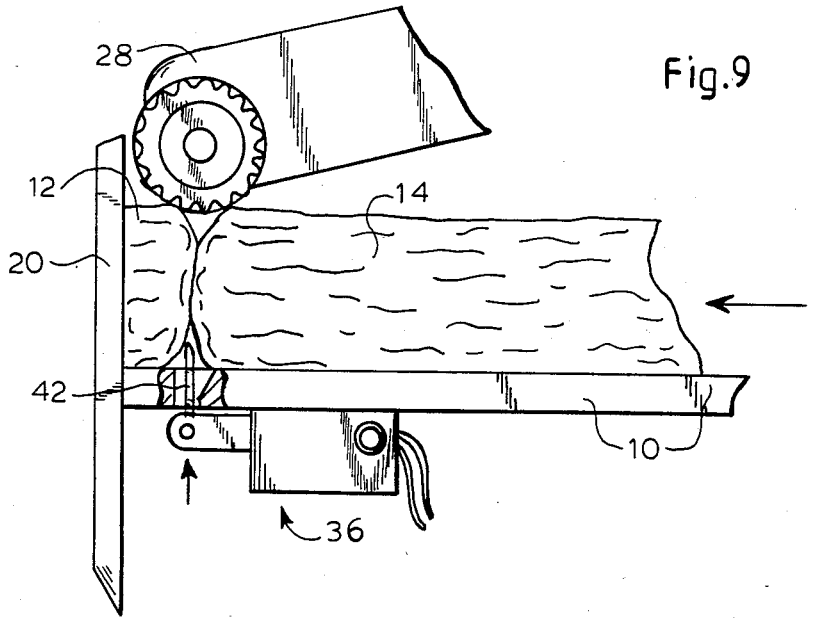
Figure 8:
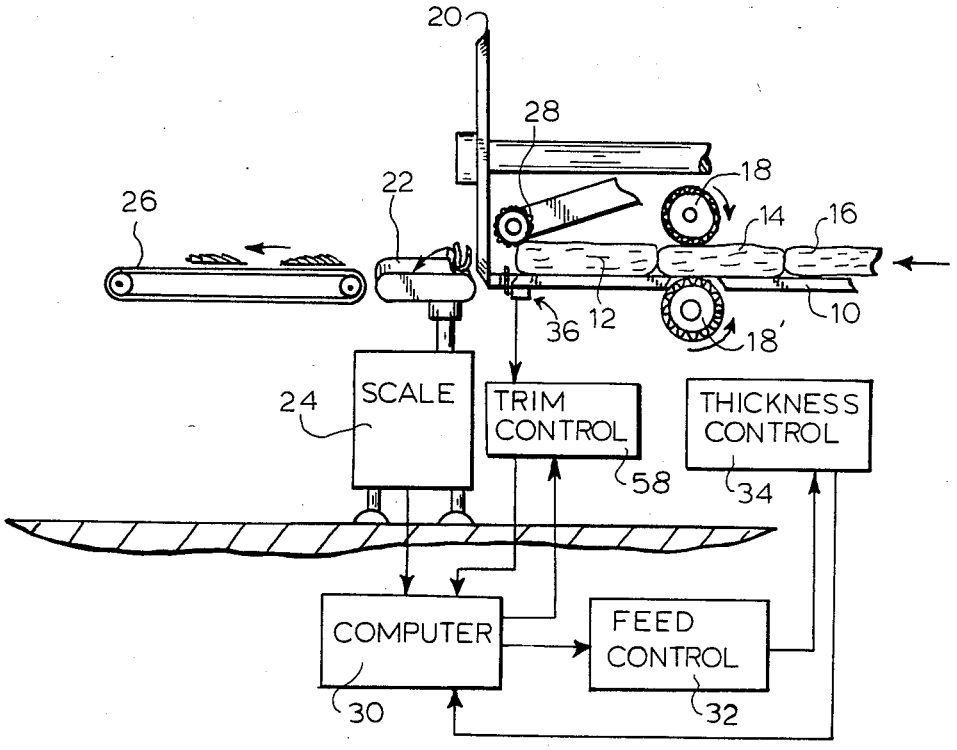
Figure 10:
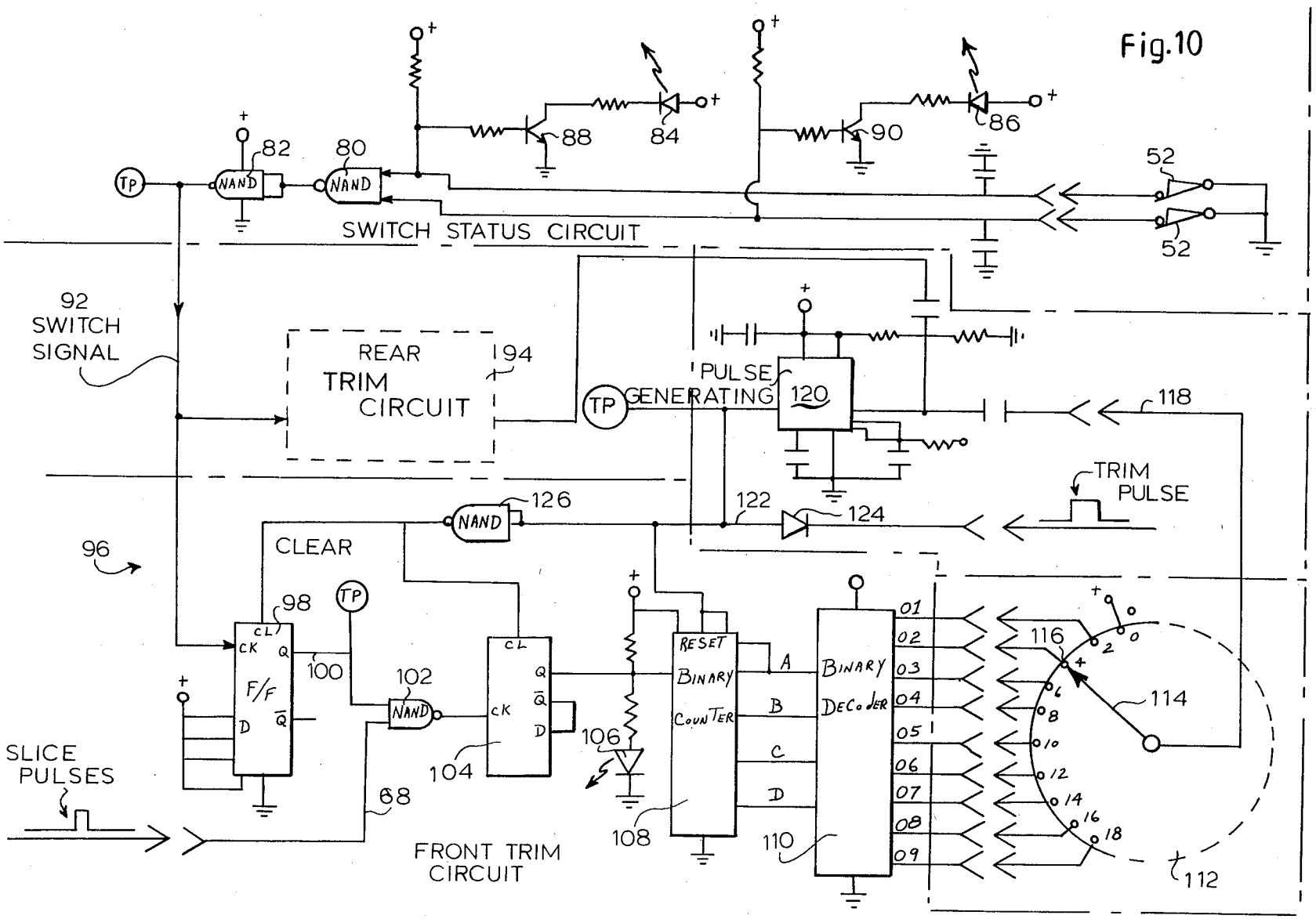
FIG. 10 shows the schematic diagram of the trimming circuit.

The trim control circuit 58 described above may be implemented in a number of ways. One way is shown in FIG. 9. However it must be understood that the same functions could be devised from various other circuits.

According to the embodiment shown in FIG. 9, the switches 52, 52' in their closed position ground the inputs of a first NAND gate 80. The output of the first NAND gate 80 is both input of a second NAND gate 82 which, therefore serves as an inverter. Therefore the output of the second NAND gate is "high" when both switches are opened and "low" otherwise. Thus the two NAND gates 80, 82 comprise the switch status circuit 60 of FIG. 5.

Two light emitting diodes (LED's) 84 are coupled through two transistors 86 and 88 in the usual manner to indicate the respective positions of the switches 52, 52' to the operator. If a particular LED is ON the respective switch is open, i.e. a bacon belly is disposed on top thereof. Obviously these LED's are also very helpful during trouble shooting.

The switch signal is fed on line 92 to the rear trim count circuit 94 and front trim count circuit 96. Since the rear and front trim count circuits are essentially identical only the front trim count circuit 96 is illustrated and described herein.

The switch signal comprises the input of a first flip-flop 98. The output 100 of the flip-flop and the slice pulses received on line 68 defined above comprise the input to a third NAND gate 102. NAND gate 102 outputs pulses synchronous with the slice pulses only when the output of flip-flop 98 is high. This third NAND gate output is fed into the clock gate of a second flip-flop 104 which has its D and Q gates connected together so that said flip-flop acts as a frequency divider. Therefore flip-flop 104 outputs a pulse on its port Q corresponding to every second pulse from NAND gate 102. The output of the second flip-flop is monitored by LED 106 and is fed into a binary counter 108. The binary counter outputs a 4-bit binary number on lines A, B, C, D which is equal to the number of pulses it receives from the second flip-flop 104. This 4-bit word is fed into a binary decoder 110 which is adapted to energize only one of its outputs, indicated in FIG. 9 by 01–09, for a particular binary word received from the counter. For example when counter 108 counts two pulses from flip-flop 104, its output is 0010 and output 02 of the decoder 110 goes "high".

The outputs 01–09 of the decoder are connected to a multiple position switch 112 which has a wiper arm 114 which can be selectively connected to any one of a plurality of terminals, as shown. This switch 112 comprises the front count select means 64 of FIG. 5. The operator selects the desired number of slices to be trimmed from the front end by setting the wiper arm 114 of switch 112 to the desired position. For the example shown in FIG. 9, the wiper arm is in contact with terminal 118 which is connected to output port 02 of decoder 110. As the counter 108 counts upwards the decoder raises each one of its outputs 01–09 sequentially to a "high" until the terminal 116 is reached. The "high" signal from terminal 02 is transmitted through wiper arm 114 on line 118 to a pulse generating circuit 120. In response, circuit 120 generates a single pulse on line 122 which travels across blocking diode 124 to computer 30. This is the trim pulse that initiates the above-described trimming phase.

The pulse from circuit 120 is also used to reset binary counter 108, and to clear flip-flops 98 and 108 through an inverting NAND gate 126. The circuit is provided with a number of test points marked TP on FIG. 9 used during trouble shooting to monitor the circuit.

For the circuit presented herein the positions of the multiple-pole switch 112 are marked from 0 to 18 by two's, as shown because each successive position of the switch connected to respective output ports 01–09 corresponds to two additional slices. This feature is due to the divider 104. Normally each switch is set for 10 slices.

In the above-described operation of the subject slicing machine of trimming the ends, as well as in between the two respective ends of a belly being sliced, the slicing must be stopped while the slices from the scale conveyor are removed. This is normally done by halting momentarily the forward movement of the bacon bellies. The slicing knife is not stopped during this phase.

Figure 11:
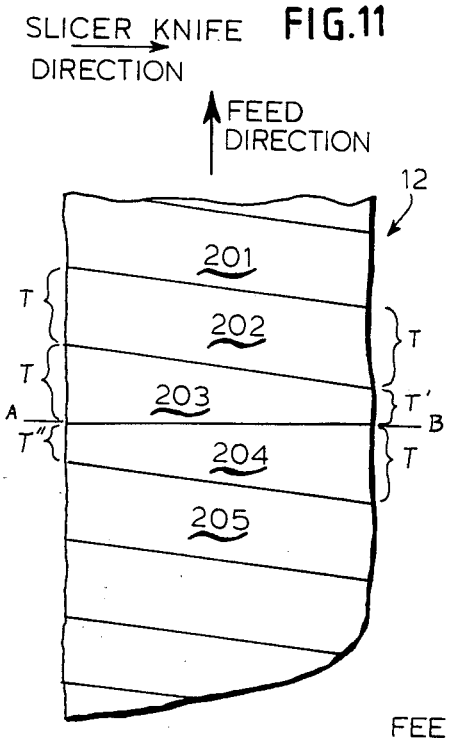
FIG. 11 shows the juxtaposed slices formed when slicing operation is halted between slices.

The method of slicing the belly can be best seen in FIG. 11 wherein a bacon belly 12 is being cut into slices 201, 202 . . . 205. As the belly is moving in the feed direction indicated by respective arrow, the slicing knife moves in a direction transversal to the feed direction from left to right. Because the belly is continuously moving the cut made by the knife is not perpendicular to the feed direction but it slopes downwards relative to the slices. However as long as the rate of feed is constant, the thickness of the slices T is the same. As described earlier this thickness may be varied by varying the feed rate. Normally the feed motor is synchronized with the slicer so that the feed is stopped only after a slice is finished. However the problem with this method is that the last piece before the forward movement is stopped and the front piece after the forward movement starts have an uneven thickness. This irregularity is caused by two phenomena. First, the whole operation is performed so rapidly, and consequently the slicer knife rotates so fast that even though the forward feed is momentarily stopped, its natural inertia causes the belly to move forward slightly into the path of the knife.

The second phenomena is illustrated in FIG. 11. If the forward feed is stopped before slice 203 is separated from the belly then the cut between points A and B separating the slices 203 and 204 is perpendicular to the feed direction. Once the forward feed is restarted all the subsequent cuts are made at an angle so that slice 205 has the normal thickness T, however, as shown in FIG. 11 slices 203 and 204 vary in thickness from T on one side to T' on the other.

Figure 12:
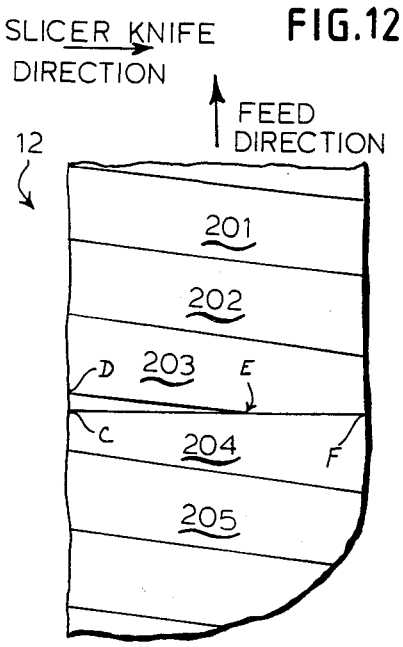
FIG. 12 shows the juxtaposed slices formed when the forward movement of the belly is halted in the middle of a slice.

The problem is somewhat alleviated if the forward feed mechanism is stopped not prior to, but in the middle of the cut. As illustrated in FIG. 12, during the cutting of slice 203, the belly moves forward while the slicer cuts from points A to B and stops while the cut from E to F is completed. A portion 210 of slice 204 however extends beyond the cutting plane oriented along line EF so that on the next rotation the slicer slices a sliver 210 off along line CE from slice 204. Thus not only is slice 204 irregular just like in FIG. 11, but in addition a sliver 210 is produced which must be wasted.

Figure 13:
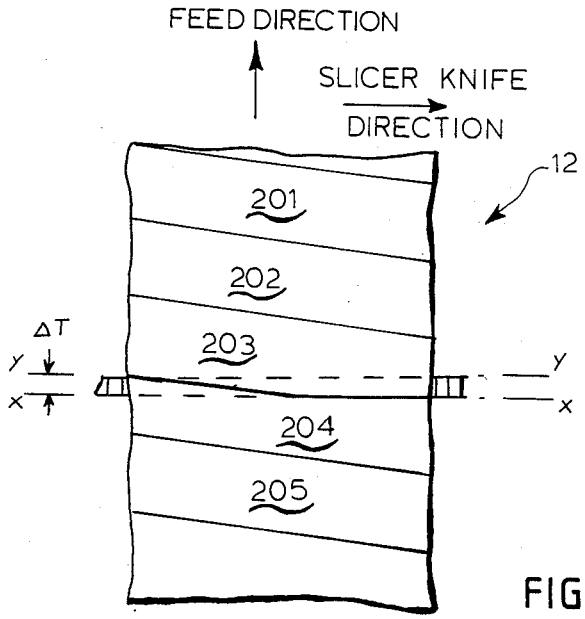
FIG. 13 shows the juxtaposed slices formed when the forward movement of the belly is halted in the middle of a slice and the belly is moved back.

In the present machine the problem is solved by first stopping the forward feed in the middle of a cut, as shown in FIG. 13 and thereafter reversing the feed drive mechanism for a very short duration of time to move back the belly by a distance T away from the slicing zone so that slice 204 clears the path of the slicer in its entirety. In FIG. 13, line X—X indicates the plane of the slicer before the belly is moved back while line Y—Y indicates the plane of the slicer with respect to the belly after the belly jumps back, the distance between the two lines being T.

Figure 14:
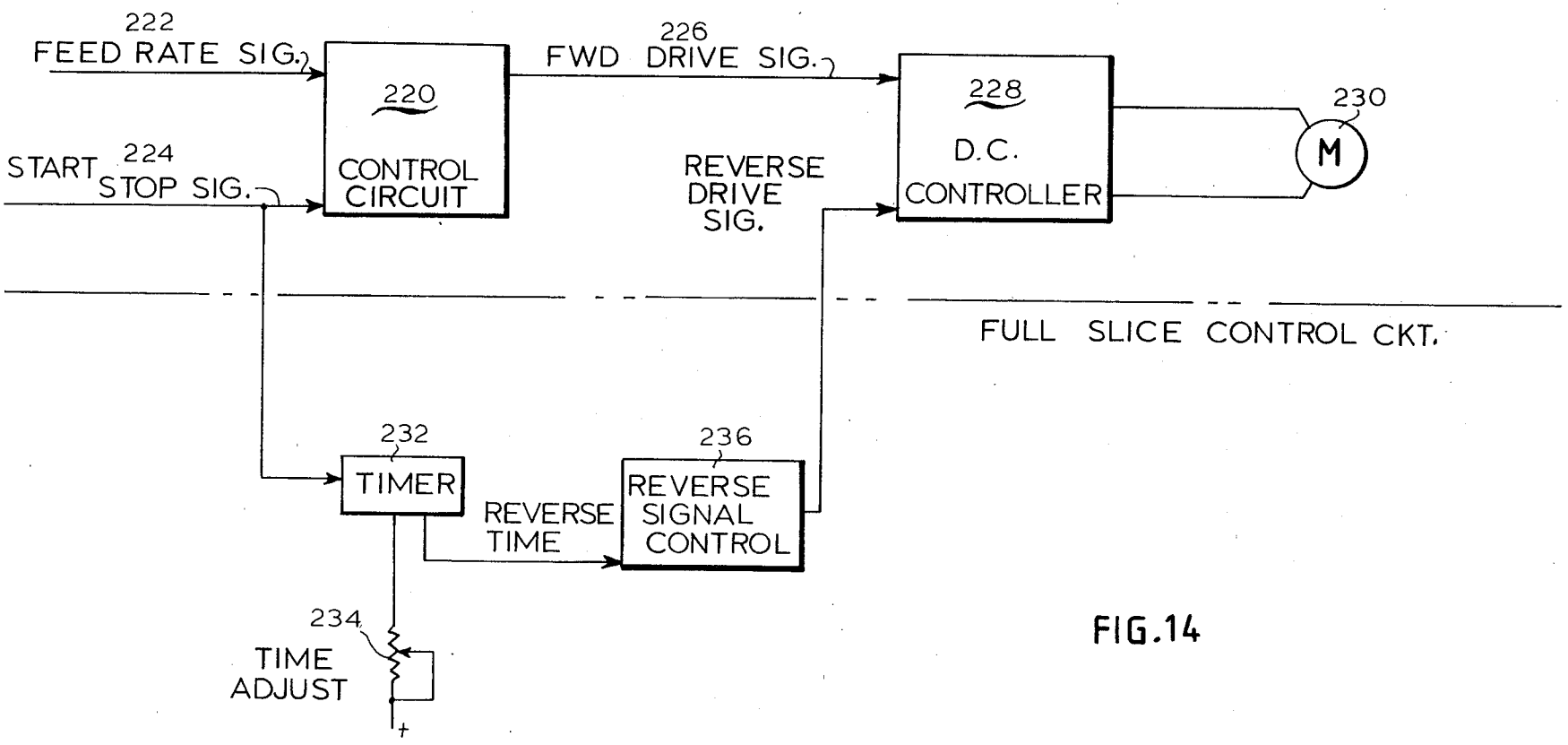
FIG. 14 shows a block diagram of the control circuit for the drive mechanism.

The above-described jump-back function may be implemented as illustrated in FIG. 14. A control circuit 22 receives a feed rate signal on line 222 and a start/stop signal on line 224. The control signal generates an appropriate forward drive signal on line 226 which is fed to a D.C. controller 228, which in turn controls the feed motor 230. The feed rate and start/stop signals are generated by the computer 30 of FIG. 1 with the stop signal being automatically delayed so that it arrives in the middle of a slice. The stop signal also activates a timer 232 which may be preset as desired by potentiometer 234. On receipt of said stop signal the timer 232 energizes reverse signal control circuit 236 which sends an appropriate reversing signal to the D.C. controller. Typically the timer is preset between 0–5 msec as a result of which the belly is moved back by 0–⅛ inch.

Numerous changes may be made in the above described machine without departing from its scope as defined in the appended claims.

What is claimed is:

1. A slicing machine for slicing bacon bellies continuously, each belly having a front end portion, a rear end portion and main body therebetween, said end portions having an end portion cross-sectional area, said end cross-sectional area being smaller than the cross-sectional area of the main body, said machine comprising:

a platform;

a slicing means positioned adjacent to said platform;

feed means for advancing bellies disposed on said platform toward said slicing means for slicing;

means for removing slices cut off by said slicing means at first and second speeds, said second speed being lower than said first speed;

sensing means disposed at a preselected distance from said slicing means for detecting said belly ends and for generating sensing signals indicative of said belly ends; and control means for operating said means for removing slices cut from said end portions at said first speed, and for removing slices cut from the main body at said second speed in response to said sensing signals to separate slices cut from the end portions from slices cut from the main body.

2. The slicing machine of claim 1 further comprising trim delay means which receives a signal from said sensing means and transmits a delay signal to said control means after a preselected time delay to thereafter initiate the trimming of slices.

3. The slicing machine of claim 2 wherein said trim delay means is operable for a first period of time for the front end portion of a belly and by a second period of time for the rear end.

4. The slicing machine of claim 3 wherein said trim delay means comprises first means for presetting said first period of time and second means for presetting said second period of time.

5. The slicing machine of claim 4 wherein said first and second presetting means is set by selecting the number of slices to be sliced during the corresponding period of time.

6. The slicing machine of claim 1 wherein said sensing means comprises at least one switch member which is placed along the path taken by the bellies as they are advanced toward the slicing means, said switch being activated by the resepective front and rear end of each belly.

7. The slicing machine of claim 6 wherein said platform has a hole made through it near said slicing means, and said switch member comprises a switch activating member disposed below said platform and having an arm which is adapted to pivot through said hole and a bias means which urges said arm to extend partially above said platform, said member being provided to activate a switching element whenever a belly passes above said hole forcing said arm downward.

8. The slicing machine of claim 1 wherein said feed means are provided with means for moving said bellies toward and away from said slicing means; and said control means includes means for generating START and STOP signals for said feed means for moving said bellies toward said slicing means with each START signal and for moving said bellies away from said slicing means by a preselected distance for each STOP signal.

9. A method of processing continuously bacon bellies, each having a front end portion, a rear end portion and a main body therebetween, said end portions having a cross-sectional area smaller than the crosssectional area of the main body comprising:

advancing the bellies toward a slicing zone;

sensing the front end portion of each belly;

in response to said sensing of said front end portion, slicing a first number of end slices from said front end portion;

removing said first end slices; and slicing the main body slices from the main body; and removing said main body slices at a different rate than said first end slices.

10. The method of claim 9 further comprising sensing the rear end portion of each belly; slicing a second number of rear end slices from said rear end; and removing said rear end slices at a different rate than said main body slices.

11. A method of slicing bellies according to claim 9 including the step of moving the belly away from said slicing means if the slicing operation is halted by stopping the advancing of the belly to segregate slices into predetermined weight groups.

* * * * *